US009062447B2

(12) United States Patent
Lehane, Jr.

(10) Patent No.: US 9,062,447 B2
(45) Date of Patent: Jun. 23, 2015

(54) CONNECTOR CLIP

(75) Inventor: James J. Lehane, Jr., McHenry, IL (US)

(73) Assignee: USG INTERIORS, LLC, Chicago, IL (US)

( * ) Notice: Subject to any disclaimer, the term of this patent is extended or adjusted under 35 U.S.C. 154(b) by 1105 days.

(21) Appl. No.: 12/631,892

(22) Filed: Dec. 7, 2009

(65) Prior Publication Data

US 2011/0131913 A1 Jun. 9, 2011

(51) Int. Cl.
*E04B 9/00* (2006.01)
*E04B 9/12* (2006.01)

(52) U.S. Cl.
CPC ..... *E04B 9/122* (2013.01)

(58) Field of Classification Search
CPC ..... E04B 9/122; E04B 9/06; E04B 9/127; E04B 9/26
USPC ..... 52/22, 220.6, 506.07, 506.1, 664
See application file for complete search history.

(56) References Cited

U.S. PATENT DOCUMENTS

| | | | | |
|---|---|---|---|---|
| 4,785,603 | A * | 11/1988 | Platt | 52/667 |
| 5,216,865 | A * | 6/1993 | LaLonde et al. | 52/667 |
| 5,517,796 | A | 5/1996 | Koski et al. | |
| 5,687,525 | A * | 11/1997 | Koski et al. | 52/506.07 |
| 5,761,868 | A | 6/1998 | LaLonde et al. | |
| 6,199,343 | B1 * | 3/2001 | Sauer et al. | 52/664 |
| 6,305,139 | B1 * | 10/2001 | Sauer | 52/506.07 |
| 6,446,407 | B1 * | 9/2002 | Lehane et al. | 52/506.07 |
| 6,523,313 | B2 * | 2/2003 | Lin et al. | 52/506.06 |
| 6,729,100 | B2 * | 5/2004 | Koski et al. | 52/506.05 |
| 6,763,642 | B2 * | 7/2004 | Platt | 52/506.07 |
| 2006/0260246 | A1 * | 11/2006 | LaLonde et al. | 52/506.07 |
| 2011/0146184 | A1 * | 6/2011 | Lehane, Jr. | 52/506.07 |

OTHER PUBLICATIONS

Anonymous: "Stainless Steel Technical Information—Fabrication: Forming of Stainless Steel", [online] Mar. 29, 2008, pp. 1-4, XP002619976; Action Stainless Kwa Zulu Natal (ASKzn) Retrieved from the Internet: URL: http://www.fanagalo.co.za/tech/tech_fab_form.htm> [retrieved on Feb. 1, 2011] paragraph [0007].

International Search Report and Written Opinion dated Mar. 9, 2011 of corresponding PCT/US2010/058266, filed Nov. 30, 2010.

The Making, Shaping and Treating of Steel, Published by United States Steel Company, Sixth Edition, Complete Revision Based on the Original Text by J. M. Camp and C. B. Francis, Copyright 1951, p. 745.

* cited by examiner

*Primary Examiner* — Elizabeth A Plummer
(74) *Attorney, Agent, or Firm* — Pearne & Gordon LLP

(57) ABSTRACT

An end clip for joining runners of suspended ceilings by coupling with an identical clip, the clip being stamped from sheet metal stock with lead and trailing ends, a lateral projection and a projection receiving area behind the lead end, the clip being arranged such that when an identical clip oriented in the opposite direction of the clip and caused to laterally overlap the clip the projection of the clip is locked in the receiving area of the identical clip and, vice versa, at least one of the projection and projection receiving area having a rearward facing sheared edge forming an acute angle with the clip plane resulting from being sheared with tooling having a clearance between tooling substantially greater than 10% of the thickness of the sheet from which the clip is stamped.

5 Claims, 3 Drawing Sheets

CONNECTOR CLIP

BACKGROUND OF THE INVENTION

The invention relates to improvements in suspended ceiling grid construction and, in particular, to improvements in connector clips for ceiling grid members.

PRIOR ART

Suspended ceiling grid members or runners typically comprise relatively long main runners and shorter cross runners. Both types of grid runners have connectors to join their ends to the ends of like members to construct a ceiling expanse of greater size than the length of individual main or cross runners. These end connectors, as the industry has advanced, are typically separate clip elements permanently attached to the grid runners themselves. The end connectors or clips are metal stampings, ordinarily of steel, formed with features that enable them to couple with identical units when one connector is pushed endwise into a lap joint with an opposing end connector. Depending on the clip design, the clips may directly abut or may have runner web areas disposed between them. In general, the features stamped or otherwise formed into a connector that establish a connection are a lateral projection and the edge of a hole. The projection of one connector is received in the hole of the opposing connector and, vise versa, the projection of the opposing connector is received in the hole of the one connector. The result is a joint with two locks. In practice, a connection may fail under tension at a force level substantially below the design or normally expected capacity of the joint. This can occur when the joined connectors slip sideways and disconnect one lock engagement resulting in a severe reduction in the load capacity of the joint.

SUMMARY OF THE INVENTION

The invention provides an end connector clip for suspended ceiling grid runners with improved clip-to-clip locking action. The improved locking function, in accordance with the invention, is achieved by orienting the locking surfaces with an angle relative to the plane of the clip body proper greater than what results from conventional practice. A preferred manner of forming the inventive locking surfaces is by increasing the clearance between the punch and die elements that create the locking surfaces. This technique, it has been found, develops an orientation of a locking surface that, in use, counteracts forces that tend to laterally separate mating locking surfaces of a pair of coupled clips which otherwise could result in a major loss of retention force. Ideally, the inventive technique is applied to both a locking projection and a projection receiving area of the clip.

DESCRIPTION OF THE PREFERRED EMBODIMENT

Figures 1, 1A:
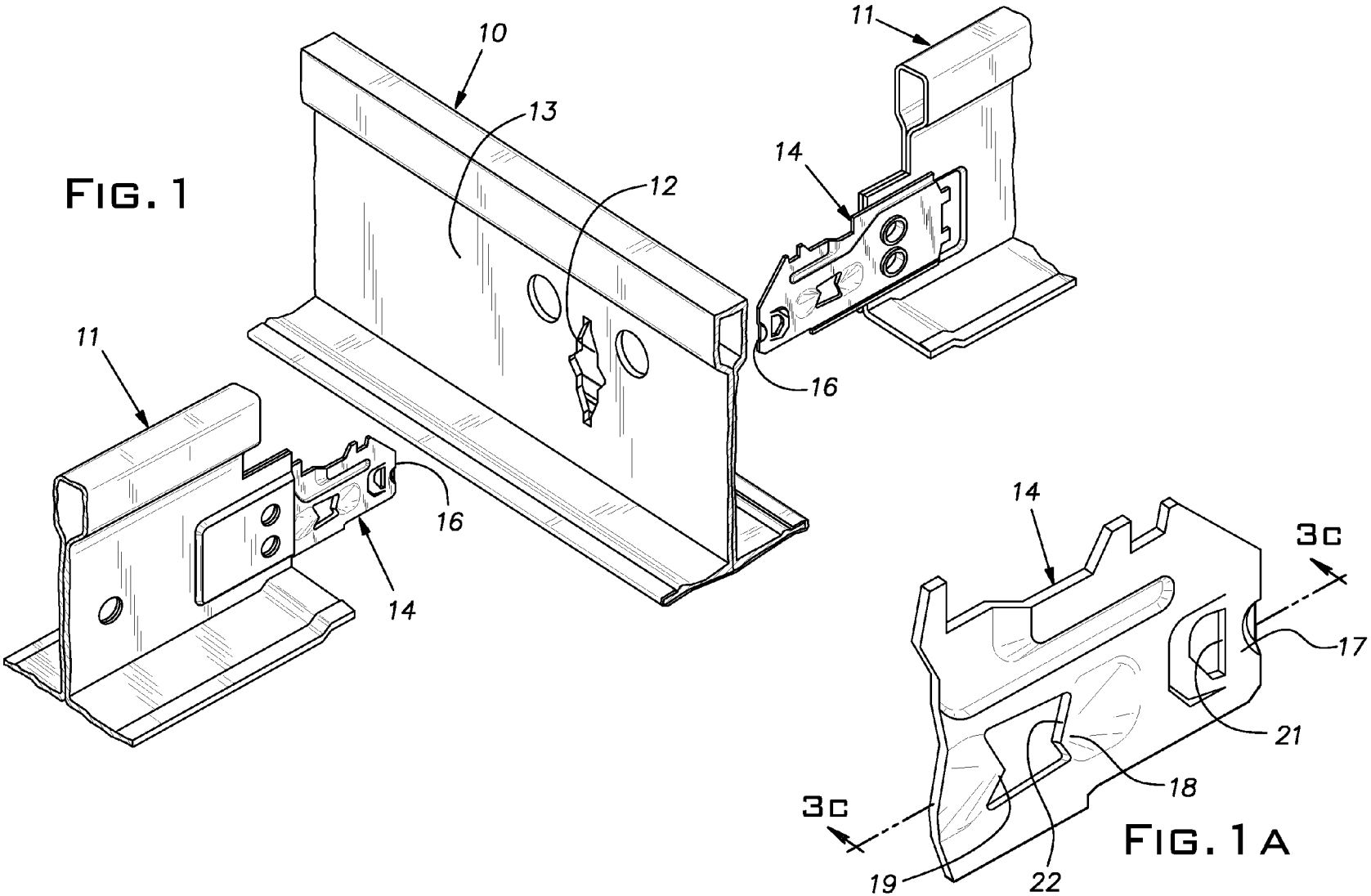
FIG. 1 illustrates portions of grid members, in the conventional form of inverted tees, for suspending ceiling panels.
FIG. 1A is an enlarged fragmentary perspective view of the locking surfaces of a grid member end connector or clip.
Figure 2:
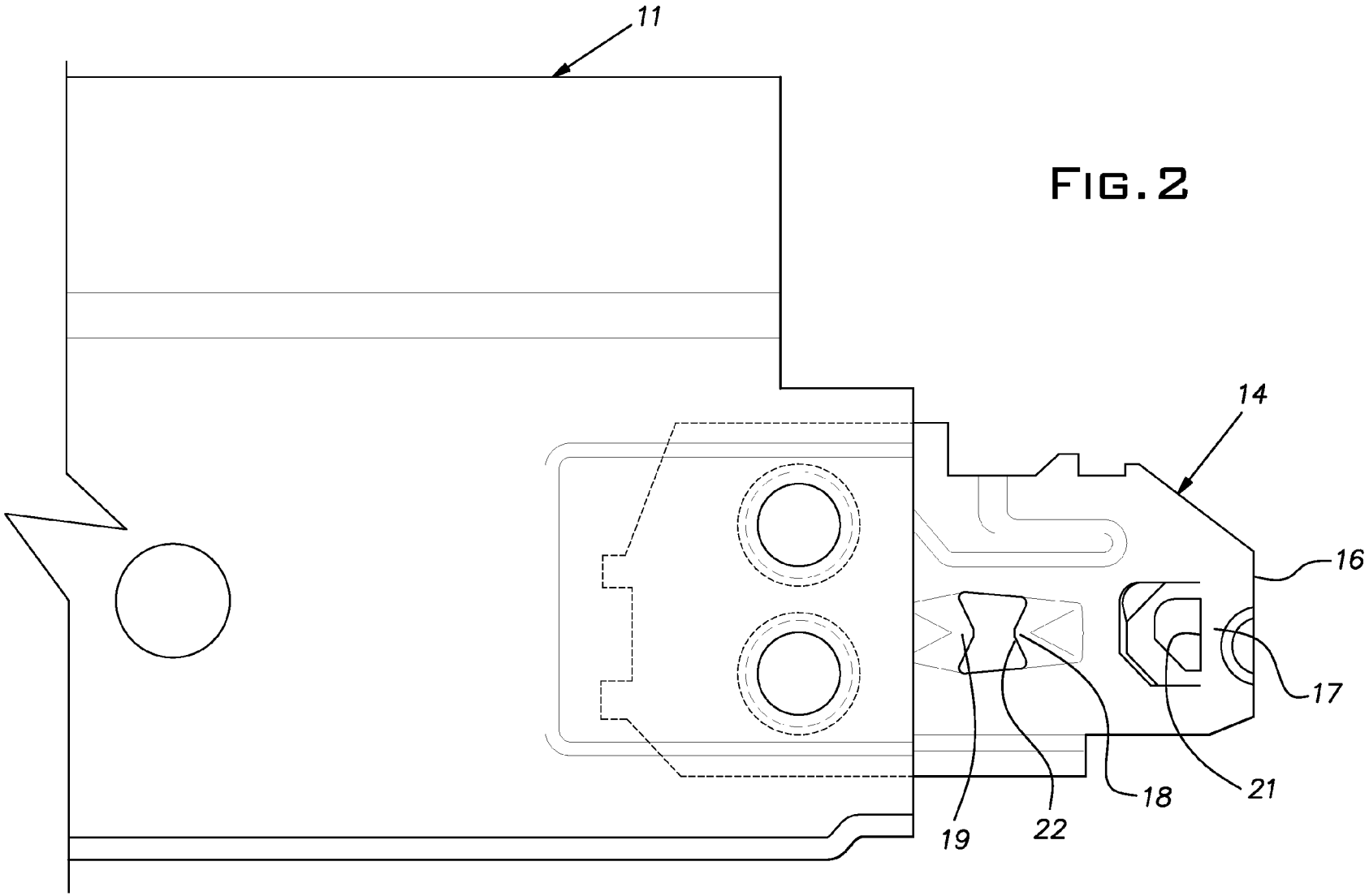
FIG. 2 is a side elevational view of the clip and end portion of a grid tee.

Referring now to the drawings and in particular to FIG. 1, portions of generally conventional suspended ceiling grid runners, in the form of tees 10, 11, are depicted. A main tee 10 has a vertically oriented slot 12, one of many at regularly spaced intervals along its length in a central web 13. End portions of opposed cross tees 11 are positioned in line with the main tee slot. The tees 10, 11 are preferably roll-formed from light gauge sheet metal stock as is customary. The main tee 10 can have a typical length of 10 or 12 feet or metric equivalent and the cross tees 11 can have lengths of 4 feet, 2 feet, and 1 foot, or metric equivalent. The cross tees 11 have identical end connectors or clips 14 fixed to their ends such as by staking portions of the tee sheet metal stock through holes provided in the connectors.

The illustrated connectors 14 are of the general type disclosed in U.S. Pat. Nos. 5,517,796 and 5,761,868, the disclosures of which are incorporated herein by reference. Typically, the connectors 14 are stamped from steel sheet stock that is stronger and harder than that of the tees 10, 11. The numeral 16 indicates the forward end of a connector 14.

When two connectors 14 are positioned from opposite sides of the main tee 10 into a common slot 12, they form a joint of their respective cross tees 11 by establishing a double connector-to-connector lock. The relationship between a pair of joined connectors 14 is analogous to a handshake. More specifically, when clips 14 are joined they lap one another, preferably in direct abutment. The clips 14 are locked together when a lock area 17 of one clip 14 snaps or is otherwise received behind a forward one of two opposing projections 18, 19 stamped into the body of the other clip 14. This same action occurs where the corresponding lock area 17 of the other clip is received behind the forward projection 18 of the one clip 14. With both sets of lock areas 17 and projections 18 engaged, a double lock clip connection is established. The lock area 17 and projection 18 interengagement serves to resist tensile loads on the associated cross tees 11 tending to separate them and under proper conditions can sustain relatively high forces.

Experience reveals that a joint between a pair of clips 14 will separate under relatively low forces if one of a set of locking area 17 and projection 18 slips laterally, i.e. perpendicular to the planes of the clips 14. This can leave only one lock set between a lock area 17 and projection 18.

Such sidewise slipping may result, inter alia, from variations in the clip material, the clip manufacturing process, deviation from an ideal clip shape, installation technique, and eccentric forces imposed on the joined clips or combinations of these factors.

The failure of a lock set by lateral movement between lock area 17 and projection 18 is related to the orientation of their respective contacting edges, designated 21, 22. The closer these edge surfaces 21, 22 are to lying in planes that are perpendicular or are obtuse to the planes of the clip bodies, the greater the risk that they will separate laterally. Locking surfaces with such orientations have little or no resistance to forces tending to laterally separate the clips 14 and when the angle is measurably obtuse a reaction force is developed by the locking surfaces in response to a tensile force between the tees that may actually cause the clips to spring laterally apart and out of contact. A locking edge surface of a projection corresponding to the projection 18 when produced with conventional practice is prone to assume an obtuse angle relative to the plane of the clip. When this edge surface is originally formed by stamping a hole in the plane of the original sheet stock forming the clip it can be slightly acute, i.e. less than 90 degrees. However, when the projection is thereafter formed out of the plane of the main part of the clip body, the edge surface can be drawn into an obtuse orientation.

Figure 3A:
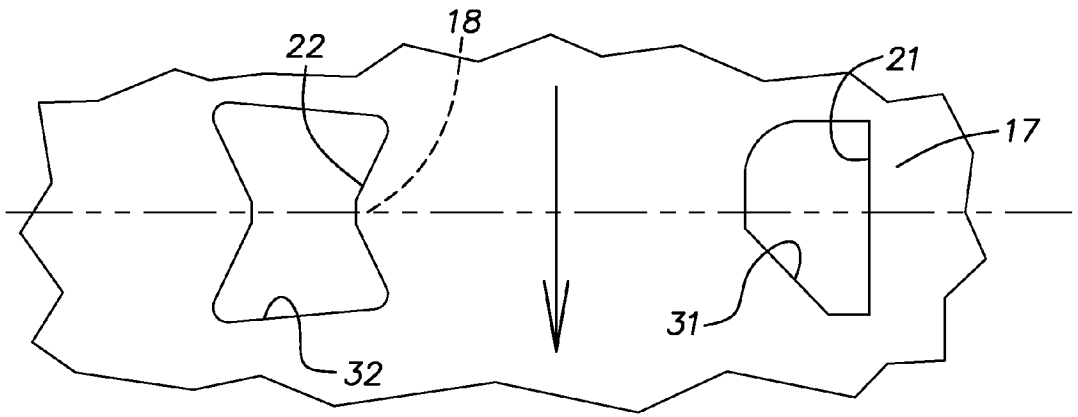
FIG. 3A is a diagrammatic presentation of the locking areas of the clip.
Figure 3B:
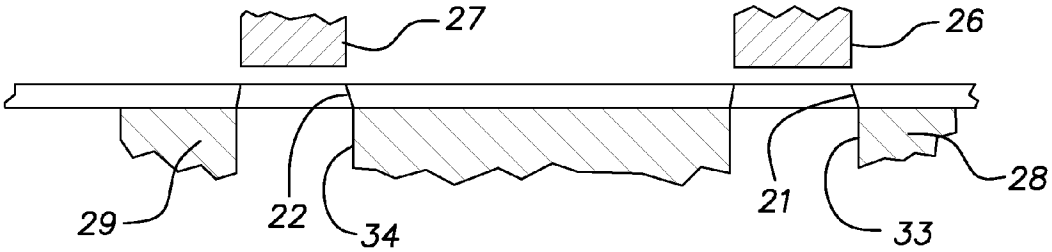
FIG. 3B is a diagrammatic presentation of tooling, in vertical alignment with FIG. 3A, used according to the invention to make the locking surfaces of the clip.

FIGS. 3A and 3B are diagrams projected vertically relative to one another illustrating aspects of the invention. In FIG. 3A, the lock area 17 is rearwardly bound by a locking area edge surface 21. Also in FIG. 3A, the eventual projection 18 and an associated lock edge 22 are indicated.

As shown in FIG. 3B, punch elements 26, 27 cooperating with die sections 28, 29 form holes 31, 32, respectively. A forward edge or boundary of the hole 31 is the lock area edge 21 and a forward edge of a bow tie shaped hole 32 forms the projection lock edge 22.

Figure 3C:
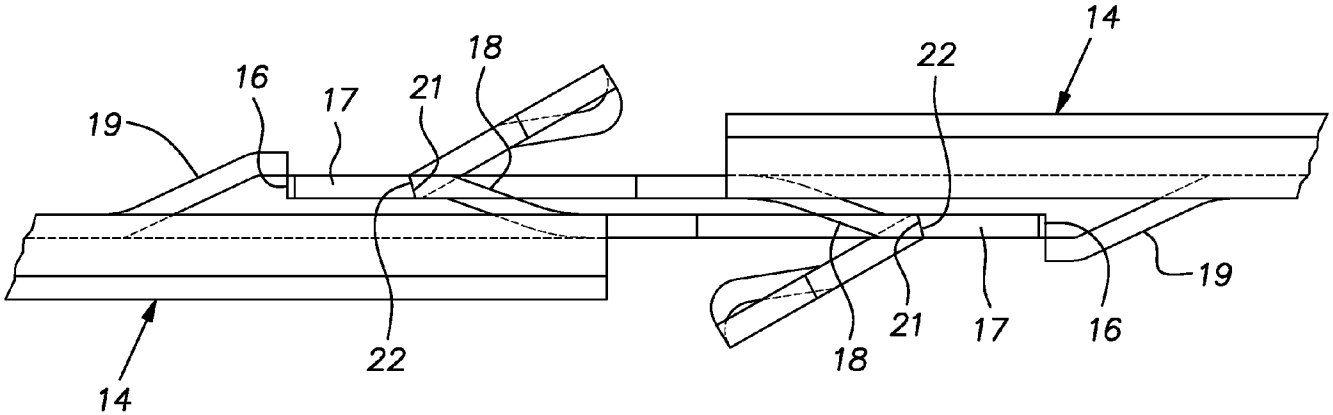
FIG. 3C shows a cross-section of portions of joined clips in a longitudinal plane transverse to the planes of the main body of the clips.

In FIG. 3C, the forward ends of a pair of mating clips 14 are diagrammatically illustrated. The images of FIGS. 3A and 3B correspond to the clip 14 on the left in FIG. 3C.

FIG. 3B shows, on an exaggerated scale, a high degree of clearance between the punches 26, 27 and die openings 33, 34 at locations corresponding to the lock edges 21, 22. As a general rule in the metal stamping industry, a punch is slightly smaller than the hole or spaced from the die or cutting edge it operates with. Typically, the clearance between the punch and die at a side of a hole is about 8% to 10% of the thickness of the material being pierced. A hole punched in a metal sheet by a punch and die generally has a diameter or hole size at the punch side equal to the punch and at the die hole side equal to the diameter or size of the die hole. This means that the punched hole, if round, is actually slightly tapered, i.e. conical, across the thickness of the sheet material or if the hole has a different configuration its walls are tapered from the size of the punch to the size of the die hole or die edge.

It has been discovered that by significantly departing from traditional practice and increasing the clearance between the punch elements 26, 27, and die openings 33 and 34, the angularity of the lock edges 21, 22 can be advantageously increased. For example, the clearance between the punch elements 26 and 27 and their respective die openings 33, 34 corresponding to the lock edges 21, 22 can be about 25% of the thickness of the sheet metal used to form the connector or clip 14. The illustrated clip 14 can be formed of 0.015/0.017 inch high tensile steel (160 KSI), stress relieved or type 301/302 stainless steel, half hard. FIG. 3B shows that the punched or sheared locking edges 21, 22 are in planes forming acute angles with respect to the side of the clip engaged by the clip 14R on the right. From the foregoing, it can be understood that the cotangent of the acute angle is the clearance divided by the material thickness. Thus, where the clearance of the prior art was less than 10% of the material thickness, the cotangent of the acute angle would be less than 0.1. With the present invention, the cotangent is substantially greater than 0.1, approaching 0.25, and the angle is substantially less than existing in the prior art. These edge surface angles are retained in the finish form of a clip 14. In the case of the projection locking surface 22 which is stamped up out of the main plane of the clip body, the angularity, i.e. deviation from perpendicularity to the clip body, may be somewhat diminished but still prominent.

FIG. 3C shows that the angles of the locking edge 21 of the lock or receiving area 17 of one clip and the projection lock edge 22 of the other clip are complementary. Moreover, the angles of these surfaces 21, 22 create a force component biasing the clips 14 together when a tension force exists in the pair of tees 11 connected to the clips. Consequently, clips 14 with the acutely angled locking edge surfaces 21, 22 significantly increase the reliability of a connection. The clips 14 are less susceptible to separating at one lock area and then failing at a reduced tension level.

Those skilled in the art will recognize the applicability of the invention to main tee clips such as shown, for example, in U.S. patent application Ser. No. 11/135,058 and U.S. Pat. No. 6,523,313. In the clips shown in U.S. Pat. No. 6,523,313, the material of the tee web is interposed in the area of the locks; nevertheless, the invention has application in such constructions where the connectors, while separated by grid runner stock, are lapped with one another and the locking edges serve the same function as described herein.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A clip for joining the ends of grid runners of suspended ceilings, the clip being constructed to couple with an identical clip, the clip being stamped from sheet metal stock and including lead and trailing ends, a lateral projection and a projection receiving area behind the lead end, the clip being arranged such that when an identical clip is oriented in the opposite direction of the clip and is caused to laterally overlap the clip in the manner of a lap joint, the projection of the clip is locked in the receiving area of the identical clip and, vice versa, the projection of the identical clip is locked in the receiving area of the clip, at least one of the projection and projection receiving area having a boundary including a sheared edge facing away from the lead end of the clip, the sheared edge forming an acute angle with a plane of adjacent areas of the clip that is substantially less than an angle with a cotangent of 0.1.

2. A clip as set forth in claim 1, wherein both said projection and projection receiving area have sheared edges forming acute angles substantially less than an angle with a cotangent of 0.1.

3. A clip as set forth in claim 1, wherein the acute angle has a cotangent of about 0.25.

4. A method of making a metal clip for joining the ends of grid runners for suspended ceilings comprising stamping the clip from sheet metal stock, the stamping process including formation of a rearward facing projection receiving edge surface and a rearward facing projection edge surface, the clip being arranged to mate with an identical clip such that when the clips are in a lapped condition, the projection edge surface of the identical clip engages the projection receiving edge surface of the clip and the projection edge of the clip engages the projection receiving edge surface of the identical clip, at least one of said edges of the clip being sheared by tools with a clearance substantially greater than 10% of the thickness of the sheet material used to make the clip.

5. A method as set forth in claim 4, wherein both said projection receiving edge surface and said projection edge surface are sheared with tooling having a clearance substantially greater than 10% of the thickness of the sheet stock used to make the clip.

* * * * *